US009100744B2

(12) United States Patent
Sim et al.

(10) Patent No.: US 9,100,744 B2
(45) Date of Patent: Aug. 4, 2015

(54) EARPHONE SET

(75) Inventors: Wong Hoo Sim, Singapore (SG); Yew Teng Too, Singapore (SG)

(73) Assignee: Creative Technology Ltd, Singapore (SG)

( * ) Notice: Subject to any disclaimer, the term of this patent is extended or adjusted under 35 U.S.C. 154(b) by 230 days.

(21) Appl. No.: 13/203,232

(22) PCT Filed: Dec. 17, 2009

(86) PCT No.: PCT/SG2009/000482

§ 371 (c)(1),
(2), (4) Date: Aug. 24, 2011

(87) PCT Pub. No.: WO2010/087779

PCT Pub. Date: Aug. 5, 2010

(65) Prior Publication Data

US 2012/0027215 A1 Feb. 2, 2012

(30) Foreign Application Priority Data

Jan. 28, 2009 (SG) ..... 200900584

(51) Int. Cl.
*H04R 1/10* (2006.01)

(52) U.S. Cl.
CPC ..... *H04R 1/1041* (2013.01); *H04R 1/1025* (2013.01); *H04R 2201/103* (2013.01); *H04R 2201/107* (2013.01); *H04R 2420/09* (2013.01)

(58) Field of Classification Search
CPC .... H04R 1/1041; H04R 2420/07; H04R 5/04; H04R 5/033; H04R 1/1066; H04M 1/72527; H04M 1/6041; H04M 1/72558
USPC ..... 381/74, 55, 309, 311, 370, 380, 384
See application file for complete search history.

(56) References Cited

U.S. PATENT DOCUMENTS

2006/0205349 A1* 9/2006 Passier et al. ..... 455/41.2
2007/0025579 A1* 2/2007 Kolton ..... 381/384
2007/0223719 A1* 9/2007 Huang ..... 381/74
2007/0253579 A1* 11/2007 Liu et al. ..... 381/111

* cited by examiner

*Primary Examiner* — Paul S Kim
(74) *Attorney, Agent, or Firm* — Russell Swerdon; Desmund Gean

(57) ABSTRACT

An earphone set with a first earphone and a second earphone, the earphone set comprising: a connector for connecting the first earphone and the second earphone; a memory module for storing audio data; and a power management module for preventing short circuit or inductive surge in current arising from connection or disconnection of the first earphone or the second earphone from the connector, the first earphone comprising: a first sound driver for sound production; and a power supply module for powering the earphone set; the second earphone comprising: a second sound driver for sound production; and a processing unit for converting the stored audio data in the memory module into sound producible by the first sound driver and the second sound driver, the power supply module being adapted to provide power to the first sound driver, the memory module, the second sound driver, and the processing unit, the connector enabling a functional connection between the first earphone and the second earphone, the memory module being resided in at least one of the first earphone, the second earphone and the connector, wherein the connector being coupled to at least one controller for manipulating sound produced by the first and second sound drivers and being detachably connected to the first earphone or the second earphone.

15 Claims, 7 Drawing Sheets

EARPHONE SET

FIELD OF INVENTION

The present invention relates to an earphone set.

BACKGROUND

Earphones are widely used with portable music players for personal entertainment. Practical implementation of such devices for easy and comfortable use is of particular importance.

Furthermore, earphones and portable music players are increasingly used by joggers to provide entertainment during their runs. Many considerations go into the design of earphones for joggers, for instance, durability, weight, size, comfort and disturbances to movements.

With regard to disturbances to movements, one problem is that wires connecting the earphone set to the portable music player tend to get in the way during jogging. While wireless technology may be used, a problem is that separate power supply is required for the earphone set and the portable music player.

With regard to earphones suitable for joggers, it is observed that a jogger usually needs to slow down or stop jogging to look at the portable music player to, for instance, adjust the volume of the music played or to skip/select the music track played. While some earphones are integrated with controllers for volume and music control, this would usually restrict the use of earphones to those that are compatible to operate with the portable music player.

Sometimes during jogging, it may be necessary to remove the earphones or to switch off the music so that external sounds such as oncoming traffic or car horns can be heard when crossing a road. It may be hazardous if the shutting down control on the portable media player is not readily accessible. Removing the earphones and putting them back on again can also be a hassle.

In addition, portable music players suitable for joggers are usually integrated with a rechargeable battery. If the battery power runs out, it would be necessary to charge the battery before it can be used again. In the meantime, the player cannot be used when the battery is charging. Consequently, the jogger is stranded without any entertainment when this occurs.

A need therefore exists to provide an earphone set that addresses at least one of the above-mentioned problems.

SUMMARY

In accordance with one aspect of the present invention, there is provided an earphone set with a first earphone and a second earphone, the earphone set comprising: a connector for connecting the first earphone and the second earphone; a memory module for storing audio data; and a power management module for preventing short circuit or inductive surge in current arising from connection or disconnection of the first earphone or the second earphone from the connector, the first earphone comprising: a first sound driver for sound production; and a power supply module for powering the earphone set; the second earphone comprising: a second sound driver for sound production; and a processing unit for converting the stored audio data in the memory module into sound producible by the first sound driver and the second sound driver, the power supply being adapted to provide power to the first sound driver, the memory module, the second sound driver, and the processing unit, the connector enabling a functional connection between the first earphone and the second earphone, the memory module being resided in at least one of the first earphone, the second earphone and the connector, wherein the connector being coupled to at least one controller for manipulating sound produced by the first and second sound drivers and being detachably connected to the first earphone or the second earphone.

The at least one controller may be used for stopping sound production from one or both of the first and second sound drivers.

The at least one controller may be used for manipulating the tempo of the sound produced by the first and second sound drivers.

The at least one controller may comprise a microphone for recording sound or for voice activation of audio playback functions.

The at least one controller may be connected at a location along the connector closer to the first earphone and another controller may be connected at a location along the connector closer to the second earphone.

The processing unit may be capable of selecting stored audio data in a randomised order from the memory module for converting into sound producible at the first and second sound driver.

The processing unit may be capable of selecting stored audio data in a predefined order from the memory module for converting into sound producible at the first and second sound driver.

The power supply module may be chargeable and adapted to connect to a charger for charging.

The connector may be a retractable cable.

The earphone set may further comprise a Frequency Modulation and/or an Amplitude Modulation (FM/AM) receiver and tuner.

The memory module may be configured for data transfer with an external electronic device via a wired or wireless connector.

The earphone set may further comprise one or more light emitters for safety indication.

The memory module may be a memory card or stick detachable from the earphone set.

The first and second earphone may each comprise an ear clip or ear hook for hooking over a respective user's ear to hold the first and second earphone firmly in their position at the user's ears.

In accordance with another aspect of the present invention, there is provided an earphone comprising: a sound driver for sound production; a memory module for storing audio data; a connection port for detachable connection of the earphone via a connector to a processing unit located external to the earphone for converting the stored audio data in the memory module into sound producible by the sound driver; a power supply module adapted to provide power to the sound driver, the memory module and the processing unit, and a power management module for preventing short circuit or inductive surge in current arising from connection or disconnection of the earphone from the connector, wherein the connector being coupled to at least one controller for manipulating sound produced by the sound driver.

In accordance with yet another aspect of the present invention, there is provided a charger comprising one or more charging points for charging one or more of the power supply module, the charger further comprising: a memory device for storing audio data; a control unit for controlling data transfer between the memory device and the memory module, and for manipulating data in the memory device and the memory; and one or more data transfer connections to connect the memory device to the memory module.

BRIEF DESCRIPTION OF THE DRAWINGS

Embodiments of the invention will be better understood and readily apparent to one of ordinary skill in the art from the following written description, by way of example only and in conjunction with the drawings, in which.

DETAILED DESCRIPTION

Figure 1:
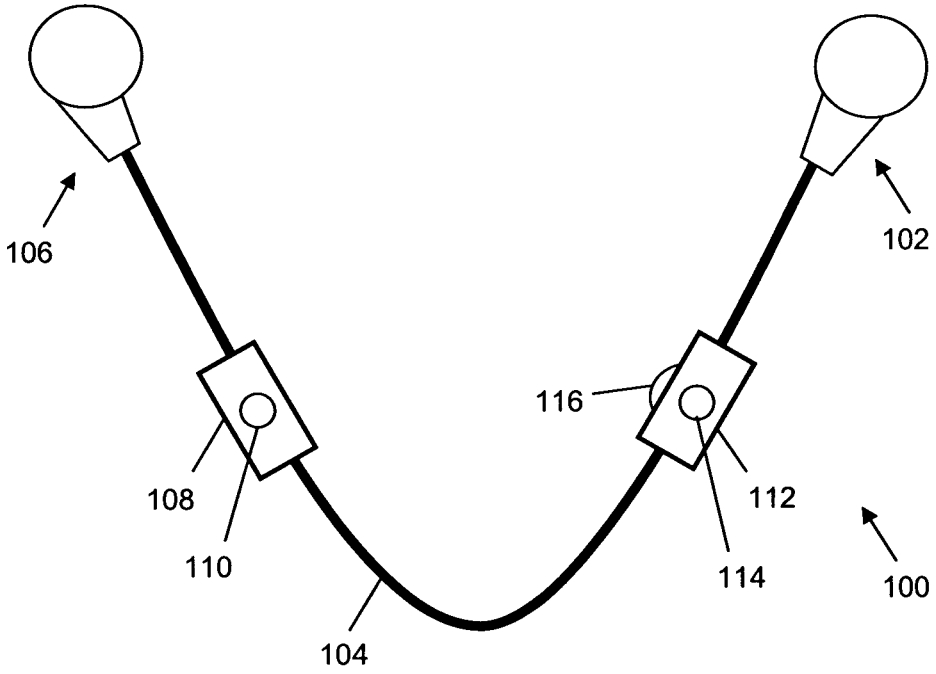
FIG. 1 shows a schematic drawing of a first example embodiment of the present invention.

FIG. 1 illustrates an earphone set 100 according to an example embodiment of the present invention. The earphone set 100 has a left earphone 106 and a right earphone 102, both of which are of the type suitable for fitting at the entrance of a user's ear canals, which includes in-ear earphones. Both earphones 102, 106 are detachably connected to each other via a main wire connection 104.

Both earphones 102, 106 cooperate to operate as an audio player for music or sound playing. Advantageously, no separate audio player needs to be connected to the earphone set 100. A single main wire connection 104 between the two earphones 102, 106 ensures minimal disturbance to a user's movement.

In the example embodiment, the right earphone 102 includes a memory module (206 in FIG. 2) for storing audio data related to sound piece(s) and a rechargeable power supply module (202 in FIG. 2) for providing power to all the components requiring power in the earphone set 100. The left earphone 106 includes a processing unit (302 in FIG. 3) for the processing/controlling operations of an audio player. Advantageously, the right earphone 102, which contains sound piece(s) data and supplies power, is interchangeable. If a user owns several units of the right earphone 102, the user has a choice of selecting the right earphone 102 with the preferred data content for use with the left earphone 106 at any juncture. Furthermore, if one of the units of the right earphone 102 runs out of power, the user would not be stranded without entertainment. The user just needs to connect another unit of the right earphone 102 with the left earphone 106. Advantageously, the left earphone 106 is also interchangeable. If it becomes faulty, it can be replaced without having to purchase the entire earphone set 100.

In the present embodiment, two controllers 108, 112 for controlling functions of the earphone set 100 are connected to the main wire connection 104. One controller 108 is connected at a location along the main wire connection 104 that is closer to the left earphone. The other controller 112 is connected at a location along the main wire connection 104 that is closer to the right earphone 102. Each of the controllers 108, 112 has activators 110, 114 respectively to allow the user to control the functions of the earphone set 100. The activators 110, 114 may be toggled between at least two states. Such arrangement of the two controllers 108, 112 allows a user to access the activators 110, 114 intuitively and conveniently. For instance, the user could use his left hand to access the first activator 110 on the first controller 108 that is closer to the left earphone 106 and use his right hand to access the second activator 114 on the second controller 112 that is closer to the right earphone 102.

There is provided a jog wheel 116 on the second controller 112 for adjusting the volume of sound produced by the left and right earphones 106, 102. Rotating the jog wheel 116 in one direction would increase the volume and rotating it in the reverse direction would decrease the volume. The jog wheel 116 may be connected to a potentiometer, or other suitable devices and circuitry known to a person skilled in the relevant art at the second controller 112 for adjusting the volume of sound produced by the left and right earphones 106, 102.

The main wire connection 104 is a single insulated wire connector consisting of a plurality of insulated wires for transferring power from the right earphone 102 to the left earphone 106 and to the controllers 108, 112, and for transmitting data, control and audio signals from the left earphone 106 to the right earphone 102, the jog wheel 116 and the controllers 108, 112.

Figure 2:
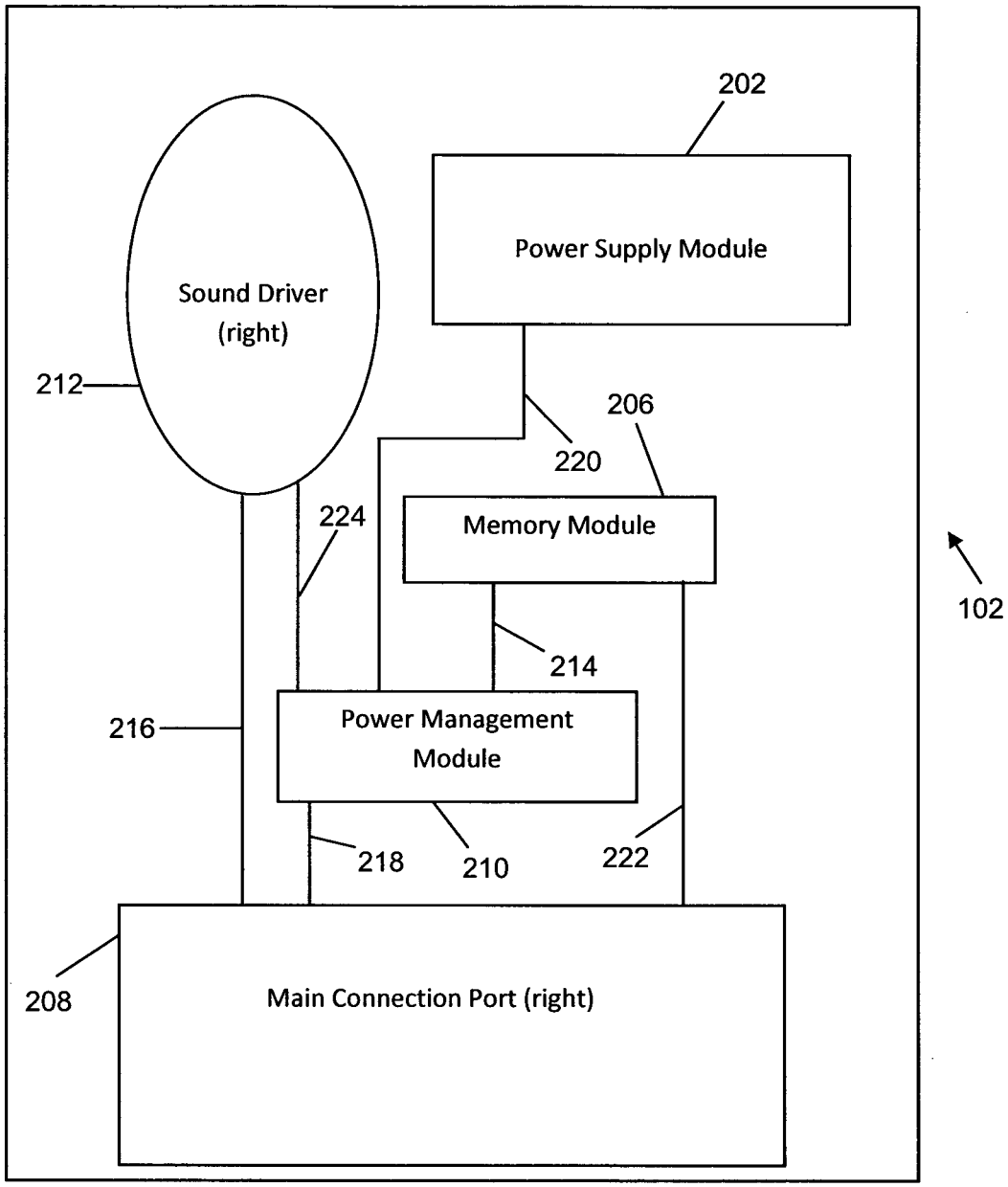
FIG. 2 shows a block diagram of the components of a first earphone according to an example embodiment of the present invention.

FIG. 2 illustrates the right earphone 102 of the example embodiment in more detail. The right earphone 102 has an right earphone sound driver 212 for sound production, a memory module 206, a power supply module 202, a female type main connection port (right) 208 for connection of the right earphone 102 to the controllers (108, 112 in FIG. 1) and the left earphone (106 in FIG. 1) via the main wire connection (104 in FIG. 1), and a power management module 210.

In the example embodiment, the power supply module 202 is a re-chargeable battery, which may be Lithium Ion based, Nickel Metal Hydride based, or the like. Power is supplied from the power supply module 202 to all the electrical components requiring power in the earphone set 100 through a first power line 220, which is connected to the power management module 210.

The power management module 210 includes circuitry for distributing power from the power supply module 202 to the respective components. In addition, the power management module circuitry is designed to prevent short circuit from, for instance, oversupply of current from the power supply module 202 to all the electronic components of the earphone set (100 in FIG. 1) at the time when the left earphone (106 in FIGS. 1 and 3) or the right earphone 102 is connected to the main wire connection (104 in FIG. 1) through the main connection port (left) (304 in FIG. 3) or the main connection port (right) 208 respectively. The power management module 210 also prevents an inductive surge in current when the main wire connection (104 in FIG. 1) is disconnected from the main connection port (left) 304 or the main connector port (right) 208 of the left earphone (106 in FIGS. 1 and 3) or the right earphone 102 respectively.

The first power line 220 connects the power management module 210 to the power supply module 202 to deliver power from the power supply module 202 to the power management module 210. A second power line 224 branching out from the power management module 210 delivers power to the right earphone sound driver 212. A third power line 214 branching out from the power management module 210 delivers power to the memory module 206. A fourth power line 218 branching out from the power management module 210 is used for delivering power to the main connection port (right) 208, which further directs the power to the controllers (108, 112 in FIG. 1) and the left earphone (106 in FIG. 1) through the main wire connection (104 in FIG. 1). The fourth power line 218 is also used to receive power through the main connector port (right) 208 from a charger (e.g. 400 in FIG. 4) for charging the power supply module 202. The power management module 210 directs the charging power received from the fourth power line 218 to the power supply module 202.

The memory module 206 is a flash memory and is mainly used for storing data played back as sound produced by the left and right earphones (106, 102 in FIG. 1). The memory module 206 also contains data and instructions related to the operation of the processing unit 302 described in FIG. 3, the jog wheel (116 in FIG. 1) and the controllers (108, 112 in FIG. 1). In the example embodiment, the memory module 206 is connected to the main connector port (right) 208 via a first data transfer bus 222. The first data transfer bus 222 allows the memory module 206 to be connected to an external electronic device via the main connector port (right) 208 for reading and writing data contained in the memory module 206. In the example embodiment, the external electronic device connected to the memory module 206 is either the processing unit (302 in FIG. 3) or the charger (400 in FIG. 4).

A first analogue audio signal line 216 connects the right earphone sound driver 212 to the main connection port (right) 208. During system operation, electrical analogue audio signals from the left earphone 106, more specifically, from the processing unit 302 described in FIG. 3, are transmitted to the right earphone sound driver 212 through this first analogue audio signal line 216.

In the example embodiment, the right earphone 102 is detachable from the main wire connection (104 in FIG. 1), which connects it to the rest of the earphone set (100 in FIG. 1) through the main connection port (right) 208. A suitable male type connection plug (not shown in the figures) is located at the end of the main wire connection (104 in FIG. 1) for connection to the main connection port (right) 208 of the right earphone 102. The male type connection plug may be magnetically attracted to the main connection port (right) 208. It is appreciated that the male type connection plug may be of the female type and the main connection port (right) 208 is a male type connector accordingly.

Figure 3:
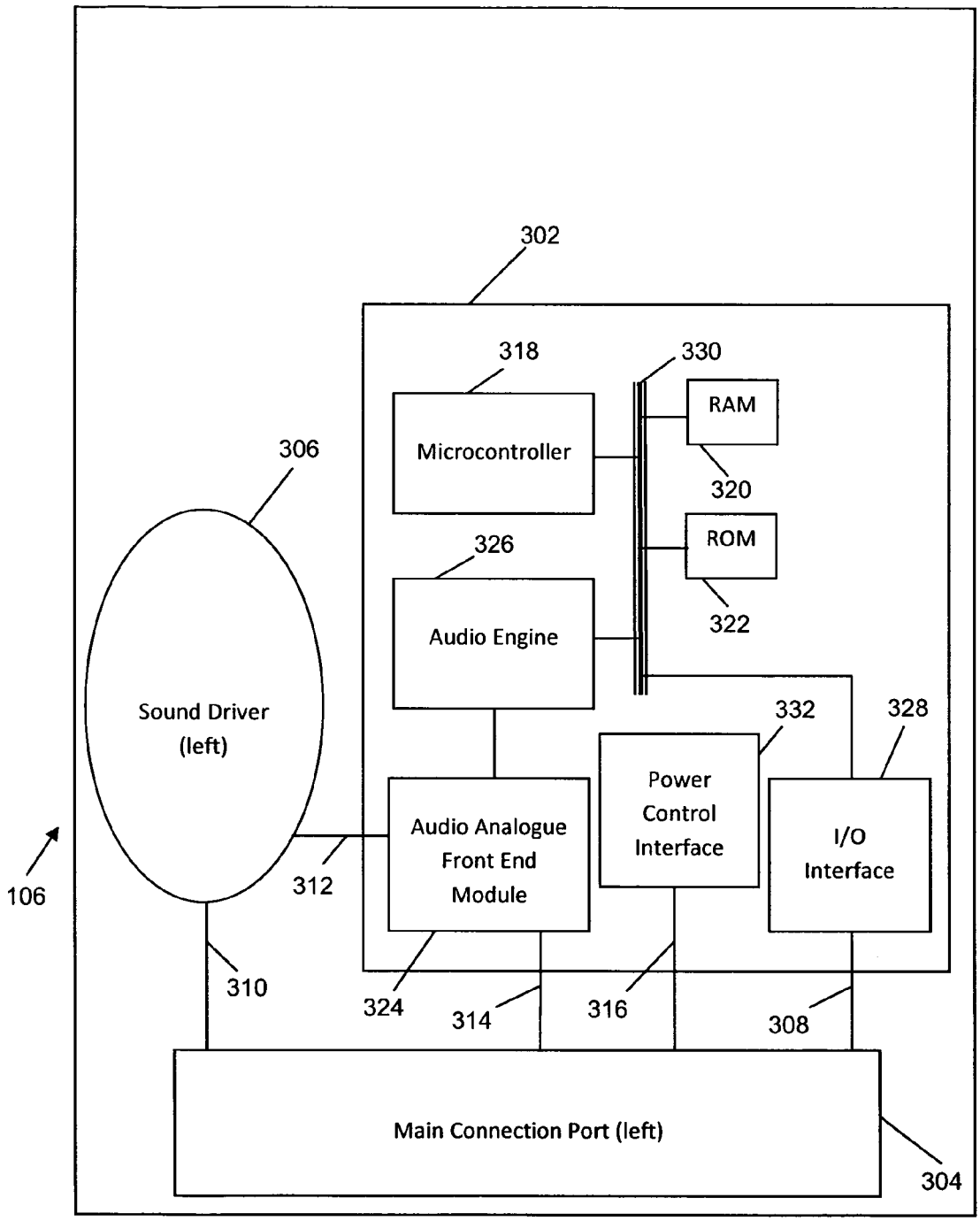
FIG. 3 shows a block diagram of the components of a second earphone according to an example embodiment of the present invention.

FIG. 3 illustrates the left earphone 106 of the example embodiment in more detail. The left earphone 106 has a left earphone sound driver 306 for sound production, a processing unit 302, and a female type main connection port (left) 304 for connecting the left earphone 106 to the rest of the earphone set (100 in FIG. 1).

In the example embodiment, the processing unit 302 includes a Microcontroller 318, an Audio Engine 326, an Audio Analogue Front End Module 324, a Power Control Interface 332, an Input/Output (I/O) Interface 328, a Random Access Memory (RAM) 320 and a Read Only Memory (ROM) 322. The Microcontroller 318 is used for processing codes and instructions associated with the operation of the processing unit 302. The RAM 320 is a volatile memory (e.g. SDRAM, DDR SDRAM, DDR2 SDRAM, DDR3 SDRAM, and the like) used to temporarily store information for processing and the ROM 322 stores the basic system information and primary instructions for the operation of the processing unit 302. The Microcontroller 318, Audio Engine 326, Input/Output (I/O) Interface 328, Random Access Memory (RAM) 320 and Read Only Memory (ROM) 322 of the processing unit 302 typically communicate via an interconnected bus 330 in a manner known to the person skilled in the relevant art.

The Audio Engine 326 is used for coding/decoding and manipulating digital audio signals. It includes audio encoders and decoders (Not shown in the Figures) for encoding and decoding audio files according to their respective formats. The Audio Engine 326 also includes an audio signal processor (Not shown in the Figures) for processing sound quality based settings and adjustments, such as, equalization changes, tempo adjustment, volume control, audio muting the Left and/or Right earphones (106, 102 in FIG. 1), Stereo/Mono setting, and the like. Processed digital audio signals are sent to the Audio Analogue Front End Module 324 for conversion into analogue audio signals.

The Audio Analogue Front End Module 324 includes Digital-to-Analogue Converters (Not shown in the Figures) for converting digital audio signals processed at the processing unit 302 into analogue audio signals required for sound conversion at the right and left earphone sound drivers 212, 306. Analogue audio signal outputs from the Audio Analogue Front End Module 324 are sent to the left earphone sound driver 306 through a second analogue audio signal line 312. Analogue audio signal outputs to the right earphone sound driver 212 are sent through a third analogue audio signal line 314, which is connected to the main connection port (left) 304. The Audio Analogue Front End Module 324 may include one or more amplifiers for audio signal amplification and noise cancellation circuitries for reducing noise. The Audio Analogue Front End Module 324 may further include Analogue-to-Digital Converters (Not shown in the Figures) for receiving analogue sound inputs from, for instance, a Frequency Modulation (FM)/Amplitude Modulation (AM) radio receiver (Not shown in the Figures), which may be integrated with the processing unit 302.

The Power Control Interface 332 manages and distributes power to all the components of the processing unit 302. It receives power from the power supply module (202 in FIG. 2) through a fifth power line 316. The fifth power line 316 connects the Power Control Interface 332 to the main connection port (left) 304 and delivers power originating from the power supply module (202 in FIG. 2) to the Power Control Interface 332 through the main connection port (left) 304.

The I/O interface 328 enables the processing unit 302 to transmit and receive data to/from the memory module (206 in FIG. 2), the controllers (108, 112 in FIG. 1), and the jog wheel (116 in FIG. 1) via a data transfer bus 308. In the example embodiment, the data transfer bus 308 is a plurality of wires consisting of a first data line (not shown in FIG. 2) connecting the processing unit 302 to the second controller (112 in FIG. 1) closer to the right earphone 102, a second data line (not shown in FIG. 2) connecting the processing unit 302 to the first controller (108 in FIG. 1) closer to the left earphone 106, a third data line (not shown in FIG. 2) connecting the processing unit 302 to the memory module (206 in FIG. 2), and a fourth data line (not shown in FIG. 2) connecting the processing unit 302 to the jog wheel (116 in FIG. 1). The I/O interface 328 may include interfaces, such as, Synchronous Serial Interface, Universal Asynchronous Receiver/Transmitter (UART) Interface, General Purpose I/O Interface with configurable drive, pull-down or interrupt function, Inter-Integrated Circuit (I2C) Interface, and the like.

In general, the processing unit 302 is part of an audio player, which has the main function of processing data from the memory module 206 and converting the data into sound producible by the left and right earphones (106, 102 in FIG. 1) respectively. The sound produced is adjustable by the processing unit 302 between stereo and mono mode. A switch (not shown in FIG. 3) may be provided for this adjustment. This switch may be connected to the I/O interface 328 of the processing unit 302. The processing unit 302 also has the function of processing and sending/receiving user selected control signals to/from the controllers (108, 112 in FIG. 1). Analogue audio signals are sent from the processing unit 302 to the left earphone sound driver 306 through a first wire connection (left) 312. The processing unit 302 is also capable of carrying out the necessary encoding/decoding/digital signal processing of data retrieved from the stored audio data in the memory module (206 in FIG. 2) for sound production at the left and right earphones (106, 102 in FIG. 1).

In the example embodiment, the playback mode executed by the processing unit 302 is either based on playing sound piece(s) having corresponding data stored in the memory module (206 in FIG. 2) in a predefined or randomised order. The processing unit 302 converts the data associated with each sound piece into sound playable at the left and right earphones (106, 102 in FIG. 1). In the example embodiment, the predefined order of playback occurs when a user inputs an arrangement of sound pieces into the memory module (206 in FIG. 2) and the sound pieces are played back in the arrangement. When all the sound pieces convertible from the stored audio data in the memory module (206 in FIG. 2) have been played back, the processing unit 302 may repeat the same playback order. In the randomised order of playback, the processing unit 302 randomly selects a sound piece for playback from all the sound pieces convertible from the stored audio data in the memory module (206 in FIG. 2). Playback in the predefined order or randomised order may be toggled by a switch (not shown in any figure) residing on either earphone (106, 102 in FIG. 1) or on one of the controllers (108, 112 in FIG. 1). This switch may be connected to the I/O interface 328 of the processing unit 302.

In the example embodiment, the processing unit 302 is further used for time scaling a sound piece being played, i.e., adjust the tempo of the sound produced by the left and right earphones (106, 102 in FIG. 1). This can be achieved by applying suitable algorithms to alter the tempo of the playing sound piece. Adjustments to the tempo can be made using the activators (110, 114 in FIG. 1) at the controllers (108, 112 in FIG. 1). Adjusting the tempo of the sound produced can advantageously provide users with, for example, motivation during an exercise or jogging session.

In the example embodiment, the sound pieces may be files having audio file formats such as way files, mp3 files, wma files, ogg files, aac files, and the like.

In example embodiment, the main connection port (left) 304 is connected to the processing unit 302 via the fifth power line 316, the data transfer bus 308 and the third analogue audio signal line 314. The current, data and signals carried in these lines are received from or delivered to the respective components through the main wire connection (104 in FIG. 1), which is connected to the main connection port (left) 304. The main connection port (left) 304 is further connected to the left earphone sound driver 306 via a sixth power line 310. The sixth power line 310 is for transmission of power from the power supply module 202 to the left earphone sound driver 306 for sound production through the main wire connection (104 in FIG. 1).

In the example embodiment, the left earphone 106 is detachable from the main wire connection (104 in FIG. 1), which connects it to the rest of the earphone set (100 in FIG. 1) through the main connection port (left) 304. A suitable male type connection plug (not shown in the figures) is located at the end of the main wire connection (104 in FIG. 1) for connection to the main connection port (left) 304 of the left earphone 106. The male type connection plug may be magnetically attracted to the main connection port (left) 304. It is appreciated that the male type connection plug may be of the female type and the main connection port (left) 304 is a male type connector accordingly.

Referring back to FIG. 1, in the example embodiment, the two controllers 108, 112 are in use both individually and in combination for controlling various functions of the earphone set 100. The functions include manipulating sound produced by the earphones 106, 102 and selecting audio pieces produced by the earphones 106, 102. All the control signals of the controllers 108, 112 are received and processed at the processing unit (302 in FIG. 3). The processing unit (302 in FIG. 3) will act according to the triggering of the activators 110, 114 at the controllers 108, 112.

In a non-limiting example, pressing both activators 110, 114 toggles a 'play' function for playback of sound pieces stored in the memory module (206 in FIG. 2). During the playback of sound pieces, pressing both activators 110, 114 toggles a 'pause' function. Pressing the first activator 110 would either increase or lower the tempo of playback. If pressing the first activator 110 causes an increase in tempo, pressing the second activator 114 would lower the tempo. The converse is also true. Pressing the first activator 110 twice in quick succession may cause skipping to another track/playlist in a first direction, while pressing the second activator 114 twice in quick succession may cause skipping to another track/playlist in a second direction.

In the example embodiment, if the main wire connection 104 is disconnected from the right earphone 102 or the left earphone 106, the last adjusted tempo level and the juncture at which the last sound piece or track played is cut off due to the disconnection would be saved. When the right earphone 102 and the left earphone 106 are reconnected with the main wire connection 104 and 'play' function is reactivated, playback of the last sound piece would resume from the juncture at which it was cut off just before disconnection. The tempo level just before disconnection would also be unchanged. This is achieved by using the processing unit (302 in FIG. 3) to update the memory module (206 in FIG. 2) with data relating to tempo levels whenever the tempo is adjusted, and with data relating to the amount of time lapsed whenever a sound piece is played. When the 'play' function is reactivated after reconnection of the main wire connection 104 with both the right earphone 102 and the left earphone 106, the processing unit (302 in FIG. 3) automatically retrieves these data from the memory module (206 in FIG. 2), executes the playback from the last time lapsed and sets the tempo accordingly.

It is appreciated that other modes of control for music/sound playing found on conventional audio players can also be implemented.

Furthermore, pressing and holding the first activator 110 may switch off the right earphone 102 during operation and leave the left earphone 106 on. Pressing and holding the second activator 114 during operation mode would switch on the right earphone 102. Pressing and holding the second activator 112 during operation may switch off the left earphone 106. Pressing and holding the second activator 114 subsequently during operation mode would switch on the left earphone 106. Switching off the earphone set 100 (essentially switching off both the left and right earphones 106, 102) may be done by disconnecting the main wire connection 104 from either earphone 102, 106. The functions of switching on or off one of the earphones 102, 106 advantageously allow a user to have one ear available to receive ambient noises and have the other ear listen to sound pieces produced by one of the earphones 102, 106.

Furthermore, in the example embodiment, when both earphones 102, 106 are functioning, i.e. switched on, it is appreciated that the sound produced by the sound drivers 212, 306 could be stereo or mono audio output. However, when one of the earphones 102 or 106 is switched off, the sound produced by the remaining sound driver 212 or 306 that is switched on would be mono audio output.

It is appreciated that the methods of implementing the controls of the activators 110, 114 are not limited only to the methods described above. Other methods can be employed for other example embodiments.

Figure 4:
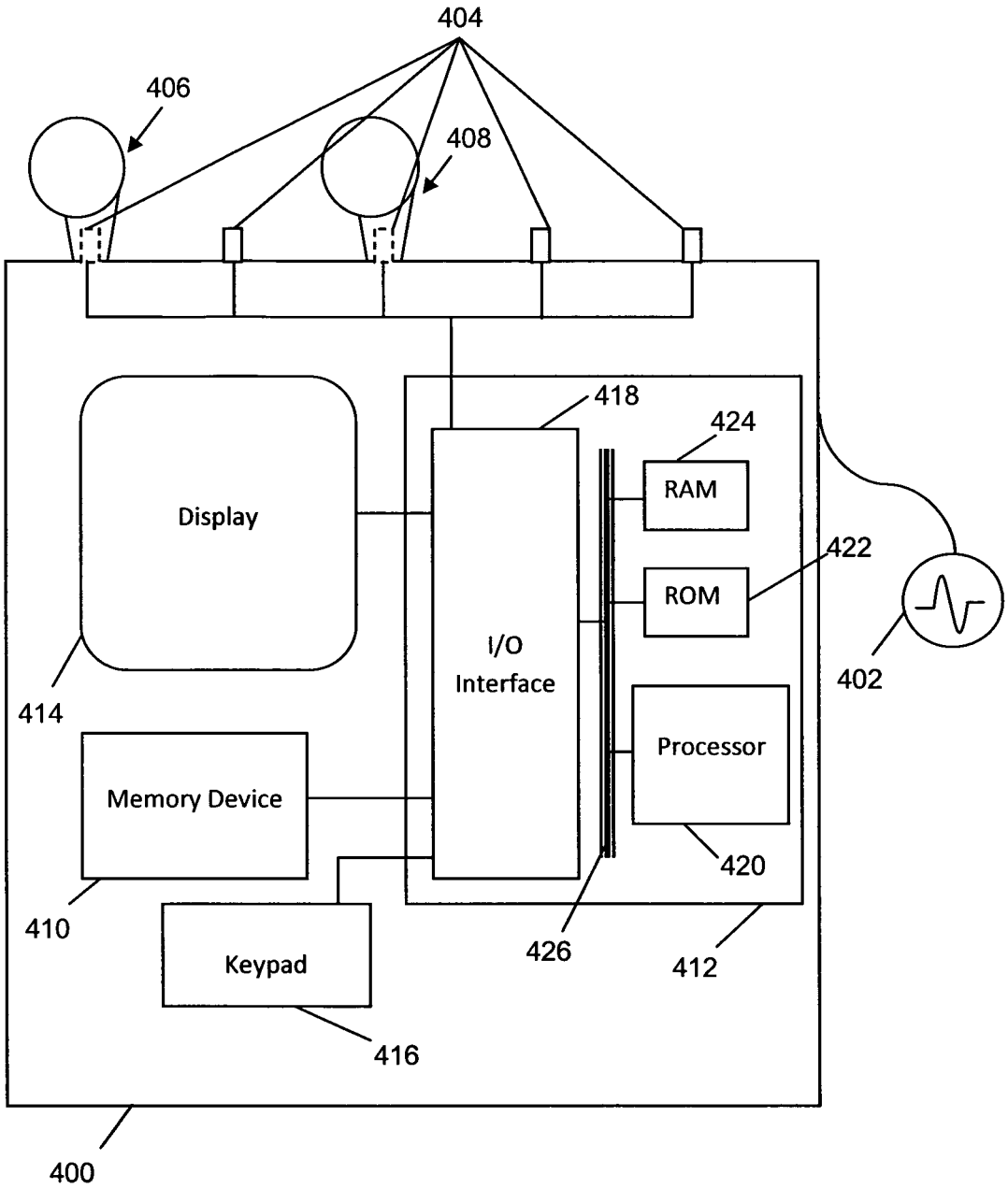
FIG. 4 shows a schematic drawing of a charger according to an example embodiment of the present invention.

FIG. 4 illustrates a charger 400 for charging the power supply module (202 in FIG. 2) through the main connection port (right) (208 in FIG. 2) of the right earphone 102 described earlier with reference to FIG. 2. The charger 400 is connected to an Alternating Current Mains 402, which supplies the power for charging the power supply module (202 in FIG. 2).

In the example embodiment, the charger 400 has a plurality of male type connectors 404, wherein each connector is suitable for coupling with the main connection port (right) (208 in FIG. 2). The connectors 404 include connections for both power transfer and data transfer. When a right earphone (102 in FIG. 2) is coupled to one of the connectors 404 of the charger 400, the connector would be connected to the first data transfer bus (222 in FIG. 2) of the right earphone (102 in FIG. 2) through the main connection port (right) (208 in FIG. 2). In addition, the power connection of the connector would be connected to the fourth power line (218 in FIG. 2) of the right earphone (102 in FIG. 2) through the main connection port (right) (208 in FIG. 2).

The charger 400 includes a charging circuit (not shown in the Figures) consisting of the relevant hardware components, such as transformers, AC to DC converters, ground lines, and the like, for charging the coupled right earphone(s) (102 in FIG. 2).

In addition to power charging, the charger 400 provides reading/writing of sound pieces in/to the memory module (206 in FIG. 2) of connected right earphones (102 in FIG. 2). Data can be read/written from/to the memory module (206 in FIG. 2) through the first data transfer bus (222 in FIG. 2) of the right earphone (102 in FIG. 2).

The charger 400 further includes a memory device 410 coupled to a control unit 412 for controlling uploading and downloading of data between the memory device 410 and the memory module (206 in FIG. 2) at a selected connector. The memory device 410 may be a flash memory device and/or Hard Disc drive and it stores sound pieces to be uploaded or downloaded to or from the connected earphones (102 in FIG. 2) and instructions relating to the uploading/downloading of the sound pieces.

The control unit 412 includes a processor 420, a Random Access Memory (RAM) 424, a Read Only Memory (ROM) 422 and an I/O interface 418 for connecting to user interface devices and to the memory device 410. In the example embodiment, the I/O interface 418 is connected to the data connection of each of the connectors 404, a Liquid Crystal Display (LCD) display 414 and a keypad 416. The I/O interface 418 may also include data transfer connections, such as, Universal Serial Bus (USB) ports, Firewire ports (IEEE1394), and the like, for connection to a laptop, mobile communication device, desktop computer, and the like. A function of these data transfer connections may be to download or upload data into the memory device 410. The display 414 displays a Graphical User Interface (GUI) for connector selection, uploading, downloading and power charging functionalities. The keypad 416 provides users with the necessary controls for selection and the uploading/downloading process between the memory module (206 in FIG. 2) and the memory device 410. It is appreciated that the user interface devices may also be a touch screen, keyboard, or the like. The control unit 412 can also be used to manipulate data stored in the memory device 410 and the memory module (206 in FIG. 2), for instance, delete and add data. The components of the control unit 412 typically communicate via an interconnected bus 426 and in a manner known to the person skilled in the relevant art.

The GUI may include charging and data management features, such as, user options for selecting a specific connector to start/stop charging, and user options for reading/writing data in the memory module (206 in FIG. 2) of a right earphone (102 in FIG. 2) coupled to a specific connector.

Advantageously, a user can own numerous earphones 406, 408 similar to the right earphone 102 described earlier with reference to FIGS. 1 to 3. The power modules (202 in FIG. 2) of the earphones (102 in FIG. 2) requiring charging can be coupled to the connectors 404 of the charger 400 via the main connection port (right) (208 in FIG. 2) for charging. As each earphone (102 in FIG. 2) has a memory module (206 in FIG. 2), different sound pieces (music/sound data) can be stored in each earphone (102 in FIG. 2). When all the power modules (202 in FIG. 2) of the earphones (102 in FIG. 2) are charged to sufficient power levels, the user has the option to select the earphone (102 in FIG. 2) containing the desired music/sound pieces that he/she wishes to listen at a specific juncture. For instance, different earphones (102 in FIG. 2) may contain music/sound pieces from different genres/artists/music albums and the user can select which earphone (102 in FIG. 2) to use according to his/her preference.

Figure 5:
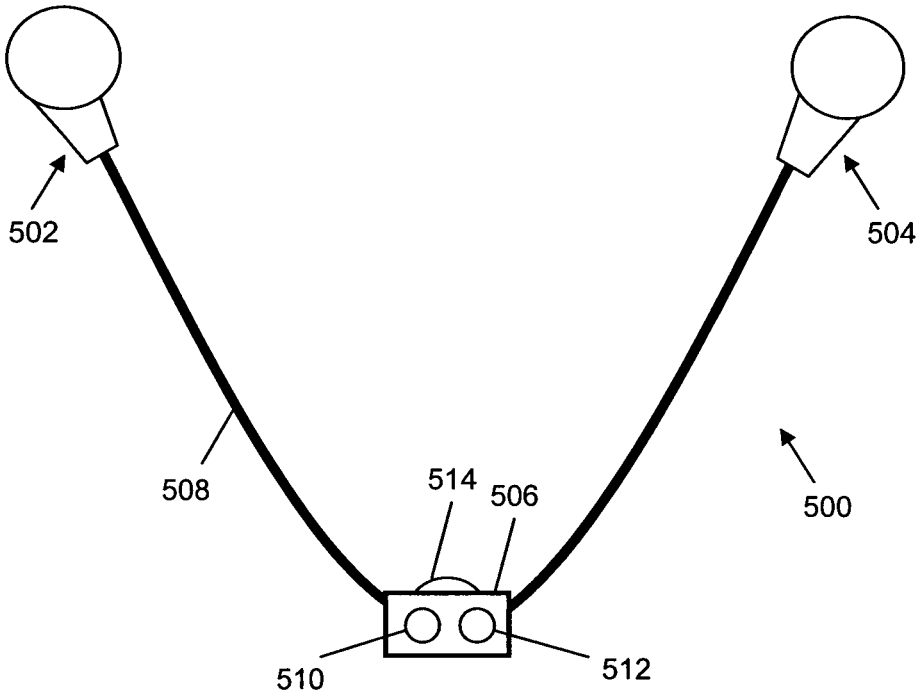
FIG. 5 shows a schematic drawing of a second example embodiment of the present invention.

In a second example embodiment, with reference to FIG. 5, there is provided an earphone set 500 consisting of a pair of left and right earphones 502, 504 detachably connected to each other via a main wire connection 508. A controller 506 consisting of two activators 510, 512 is connected at a location midway of the main wire connection 508. There is provided a jog wheel 514 at the controller 506 for adjusting the volume of sound produced by the left and right earphones 502, 504. Compared to the embodiment described with reference to FIGS. 1 to 3, there is only one controller 506 in the present embodiment. The implementation of the left and right earphones 502, 504, the wire connection 508 and the controls of the two activators 510, 512 on the controller 506 are similar to the implementation of the corresponding components in the embodiment described earlier with reference to FIGS. 1 to 3.

Figure 6:
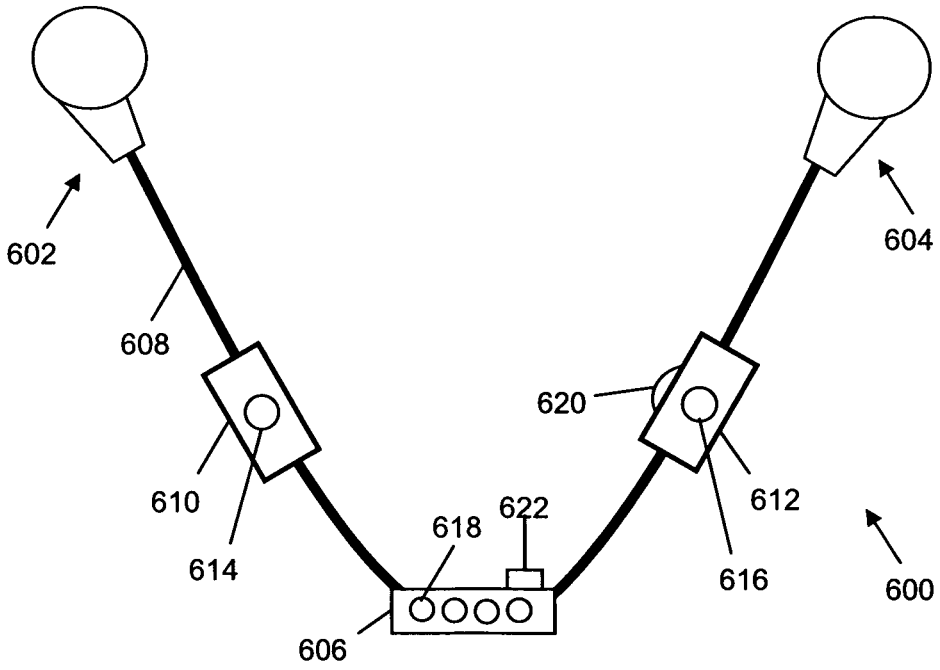
FIG. 6 shows a schematic drawing of a third example embodiment of the present invention.

In a third example embodiment, with reference to FIG. 6, there is provided an earphone set 600 consisting of a pair of left and right earphones 602, 604 detachably connected to each other via a main wire connection 608. There are provided two controllers 610, 612 for controlling functions of the earphone set 600. Each of the controllers 610, 612 has an activator 614, 616 respectively. The two controllers 610, 612 are connected to the main wire connection 608. The first controller 610 is connected at a location along the main wire connection 608 that is closer to the left earphone 602. The second controller 612 is connected at a location along the main wire connection 608 that is closer to the right earphone 604. There is provided a jog wheel 620 on the second controller 612 for adjusting the volume of sound produced by the left and right earphones 602, 604. The implementation of the left and right earphones 602, 604, the wire connection 608, the controllers 610, 612 and the controls of the two activators 614, 616 are similar to the implementation of the corresponding components in the embodiment described earlier with reference to FIGS. 1 to 3.

In FIG. 6, there is further provided an array of Light Emitting Diodes (LEDs) 618 located in a LED housing 606 between the two controllers 610, 612. The LEDs 618 may be arranged in series along the wire connection 608, and may be electrically connected to the wire connection 608 in series and/or in parallel with one another. If, for example, a user uses the earphone set 600 when jogging in dark or dimly lit areas, these LEDs 618 can advantageously serve as safety light indicators to vehicle drivers on the roads or streets. The LEDs 618 may be switched on/off by triggering a switch 622 located on the LED housing 606.

Figure 7:
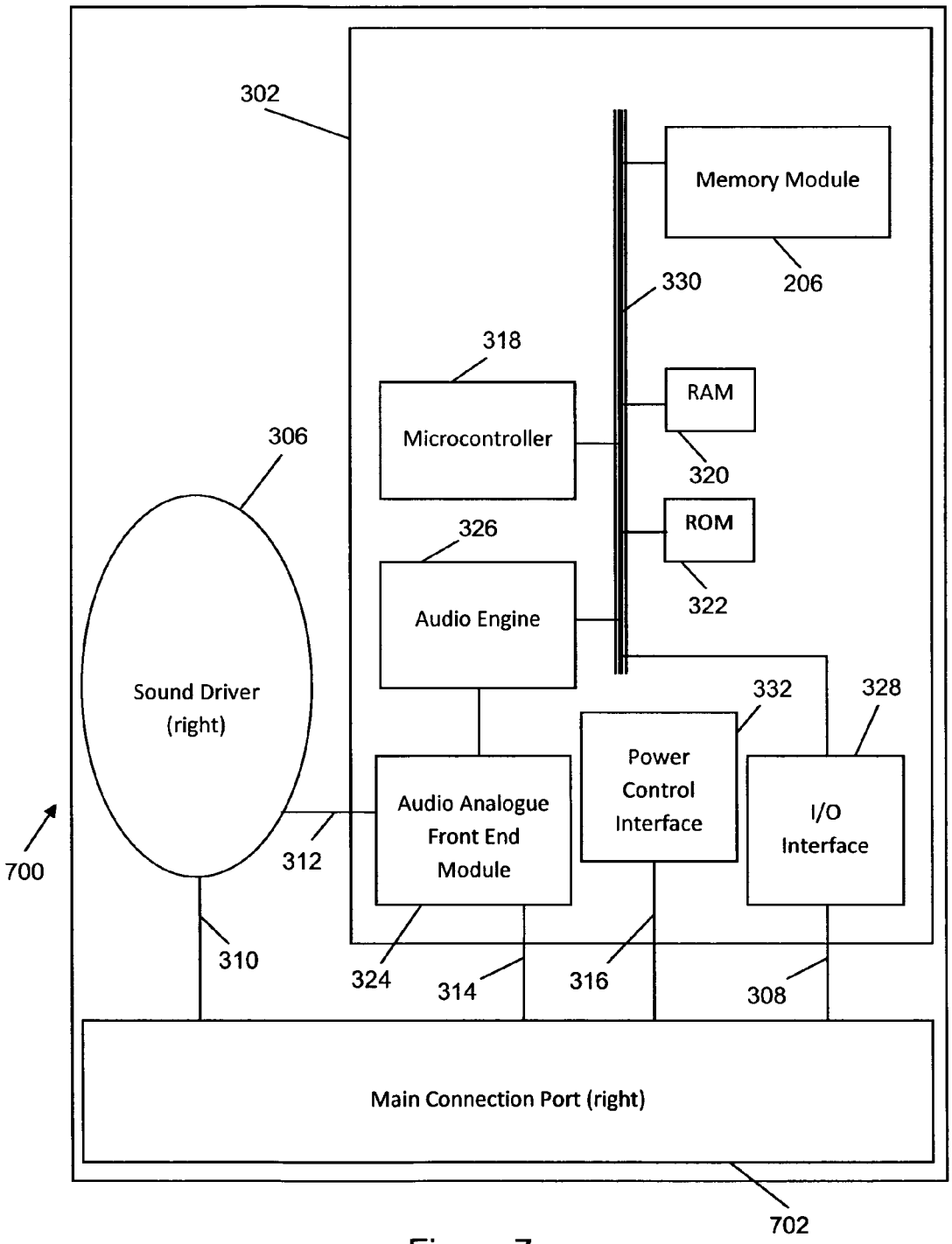
FIG. 7 shows a block diagram of the components of a first earphone according to an example embodiment of the present invention.
Figure 8:
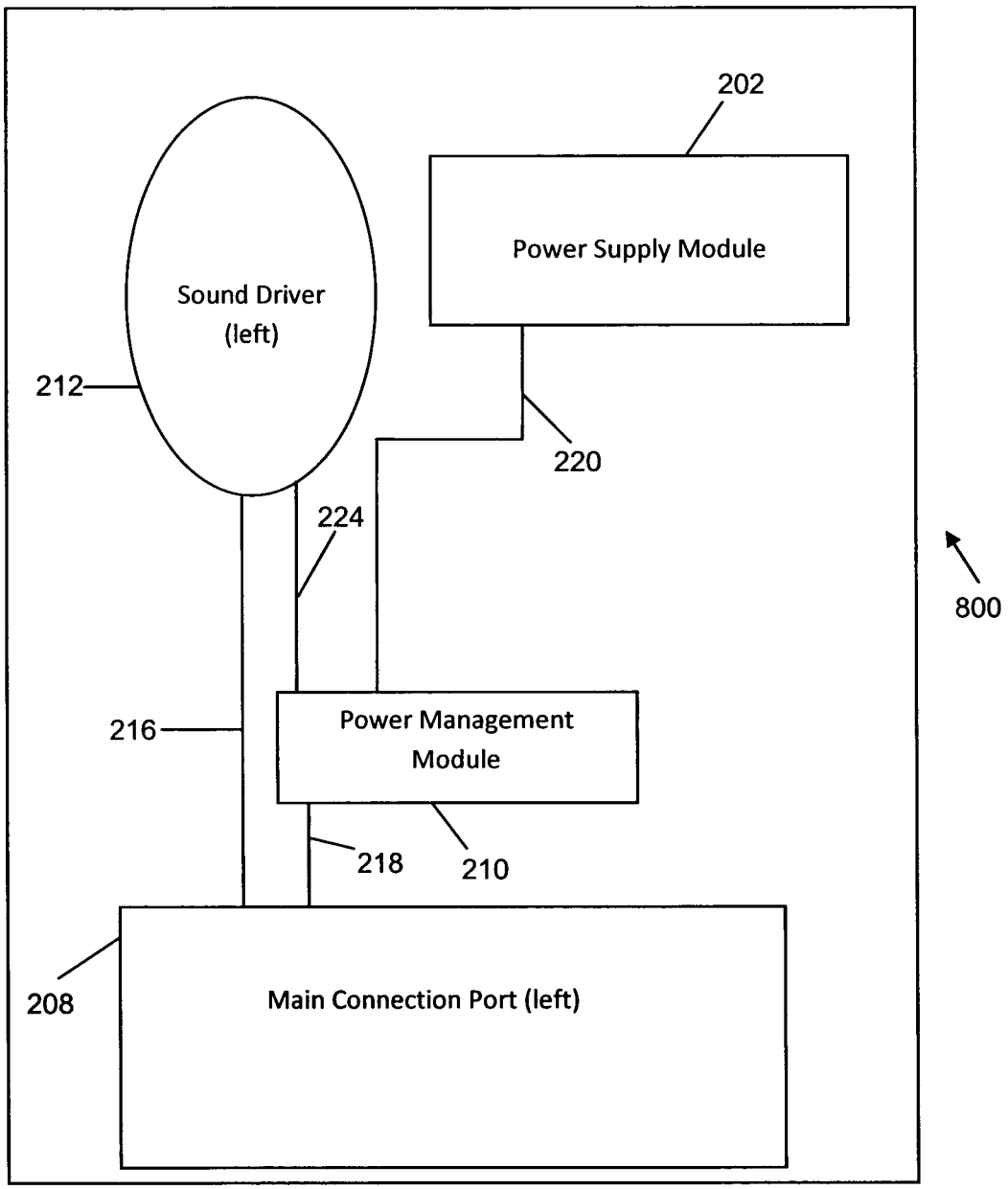
FIG. 8 shows a block diagram of the components of a second earphone according to an example embodiment of the present invention.

In other example embodiments, the roles of the left earphone (106, 502, 602) and right earphone (102, 504, 604) of the earphone sets 100, 500 and 600 respectively described with reference to FIGS. 1 to 6 may be interchanged, i.e. the right earphone has the components of the left earphone, and the left earphone has the components of the right earphone. FIGS. 7 and 8 illustrate such an embodiment. FIG. 7 shows an interchanged left earphone 106, which would be herein referred to as the right earphone 700. FIG. 8 shows an interchanged right earphone 102, which would be herein referred to as the left earphone 800.

The right earphone 700 and left earphone 800 comprise essentially the same components as the left earphone 106 and the right earphone 102 respectively except for a few differences. These differences are deliberately introduced in the right and left earphones 700 and 800 to illustrate other aspects of the present invention. The differences are discussed as follow.

With reference to FIG. 7, the right earphone 700 comprises the memory module 206 described with reference to FIGS. 2 and 3. Unlike the left earphone 106 in FIG. 3, the memory module 206 described in FIG. 2 is connected to the bus 330 and is part of the processing unit 302.

To transfer data to/from the memory module 206 in FIG. 7, a user may plug the right earphone 700 to, for instance, one of the connectors 404 of the charger 400 described in FIG. 4, through the main connection port (right) 702. In this case, the data transfer connection of said one of the connectors 404 would be connected to the data transfer bus 308 through the main connection port (right) 702. The power connection of said one of the connectors 404 would be connected to the fifth power line 316 through the main connection port (right) 702. Power supply for the processing unit 302 and the memory module 206 can be supplied through the power connection of one of the connectors 404 in connection with the fifth power line 316 and data transfer can be made between the charger 400 and the right earphone 700 through the data transfer connection of one of the connectors 404 in connection with the data transfer bus 308.

It is appreciated that data transfer to/from the memory module 206 and power supply for the processing unit 302 can be achieved by connecting the main connection port (right) 702 with other suitable devices besides the charger 400. For example, by configuring the main connection port (right) 702 as a Universal Serial Bus (USB) or an IEEE1394 (Firewire) based port, the main connection port (right) 702 can be connected to a desktop/laptop/mobile computer for data transfer. In this case, power supply for the processing unit 302 would be drawn from the computer via the Universal Serial Bus (USB) or IEEE1394 (Firewire) based connection.

In the present embodiment described with reference to FIG. 7, the I/O interface 328 would exclude use for data communication between the memory module 206 and the processing unit 302. Instead, the bus 330 would be used as the means for data communication between the memory module 206 and the other components (e.g. Microcontroller or Audio Engine) of the processing unit 302.

Advantageously, the right earphone 700 in FIG. 7 can function as an audio playback device connectable to an external power supply and other sound production devices for production of sound stored in compressed/uncompressed audio data format in the memory module 206.

With reference to FIG. 8, unlike the right earphone 102 described in FIG. 2, the left earphone 800 does not contain the memory module 206, the first data transfer bus 222 or the power line 214, as the memory module 206 has been "shifted" to the right earphone 700. As such, generally, the left earphone 800 has sound producing and power supplying capabilities but no memory storage capabilities. On the other hand, the right earphone 102 generally has sound producing, power supplying and memory storage capabilities. It is appreciated that the power module 202 of the left earphone 800 may be charged by connecting it via the main connection port (left) 208 to the power connection of one of the connectors 404 of the charger 400 described earlier with reference to FIG. 4.

In yet another embodiment, the left earphone 800 described with reference to FIG. 8 comprises all the components of the right earphone 102, including the memory module 206. In this case, the I/O interface 328 in the right earphone 700 would not exclude use for data communication between the memory module 206 in the left earphone 800 and the processing unit 302. In this case, there would be two memory modules, each residing in the left and right earphones 800 and 700 respectively. Thus, more memory storage space is provided in this embodiment.

In a further example embodiment, there may be further included in the left or right earphones 106, 102, 502, 504, 602, 604, 800, 700 in the controller 506 or one of the controllers 108, 112, 610, 612 described earlier with reference to FIGS. 1, 5, 6, 7 and 8, a microphone for recording sound and/or for receiving sound for voice activation of audio playback functions of the sound producing systems 100, 500 and 600. In this case, a suitable speech recognition algorithm would be programmed in the firmware of the earphone set of the embodiment to enable the voice activation capability. Also, one or more buttons for activating/operating the microphone may, in this case, reside in the left or right earphones 106, 102, 502, 504, 602, 604, 800, 700 in the controller 506 or one of the controllers 108, 112, 610, 612.

It is further appreciated that each of the right earphone sound driver 212 and the left earphone sound driver 306 described earlier with reference to FIGS. 2 and 3, and present in FIGS. 7 and 8, may be an electromechanical device, such as, an acoustic transducer that is suitable for converting electrical analogue sound signals into sound. The sound produced by these drivers may cover the full audible frequency range or at least a major portion of the audio frequency range.

Also, each of the power lines 220, 224, 214, 218, 316, 310 described earlier with reference to FIGS. 2 and 3, and present in FIGS. 7 and 8, which are used for delivery of power may be split into a plurality of wires including a ground line, a voltage line or the like required for power transmission.

The controller 108 closer to the left earphone 106 described earlier with reference to FIG. 1 may be located adjacent to or incorporated with the left earphone 106. Similarly, the controller 112 may be located adjacent to or incorporated with the right earphone 102. The same may be implemented for the controllers 610, 612 described earlier with reference to FIG. 6. Also, the controllers 108, 112 may be implemented such that they could be used to manipulate the stored data in the memory module 206, e.g. delete audio data related to a particular sound piece.

Furthermore, more activators may be added to the earphone sets described earlier with reference to FIGS. 1 to 8 for implementation of more functions. The activators may be further used for bass, treble control or the like. In addition, the activators 110, 114, 510, 512, 614, 616 described earlier with reference to FIGS. 1, 5 and 6 may also be electrical and/or mechanical based user input means such as a push button, a switch, a sensor, or the like.

The memory module 206 described earlier with reference to FIGS. 2 and 7 may be a memory card or stick based on the formats Secure Digital (SD), Mini SD, Micro SD, Secure Digital High Capacity (SDHC), Multimedia Card (MMC), Compact Flash (CF), Memory Stick PRO; Memory Stick Duo, Memory Stick PRO Duo, Memory Stick Micro (M2), Memory Stick PRO-HG, and the like that is detachable from the right earphone 102 and the right earphone 700 respectively. Correspondingly, there would be slot(s) for housing the memory card or stick located on the right earphone 102 and right earphone 700 respectively.

The one or more of the power management module 210 described earlier with reference to FIG. 2, and present in FIG. 8, may be located in one, in some or in all of the controllers 108, 112, the left earphone 106 (or the right earphone 700 in FIG. 7) and the right earphone 102 (or the left earphone 800 in FIG. 8).

It is appreciated that the main connection ports 208 and 702 described with reference to FIGS. 2 and 7 respectively may be USB or Firewire connectors. Hence, the left earphone 106 and right earphone 700 can be conveniently connected to an external electronic device such as a portable computer, a desktop computer, or the like, for uploading, downloading, reading or writing data to/from the memory module 206 connected to the processing unit 302. Alternatively, or additionally, the processing unit 302 may contain a wireless transceiver such as a Bluetooth transceiver, or the like, for connecting to the external electronic device wirelessly for uploading, downloading, reading or writing data in the memory module 206.

A Frequency Modulation (FM) and/or Amplitude Modulation (AM) radio receiver and tuner may be included in one of the left or right earphones 106, 102, 502, 504, 602, 604, 800, 700 described earlier with reference to FIGS. 1 to 8, to enable the earphone sets described to receive and tune radio station transmissions.

The jog wheel 116 described earlier with reference to FIG. 1 may be replaced by other activators such as a sliding bar control, volume increase/decrease push buttons, or the like. The jog wheel 116 may also be used for adjusting the intensities of other parameters besides volume that are related to sound quality, for instance, tempo, bass, treble, or the like. Further, the jog wheel 116 may be used for toggling between different playback modes and for tuning FM/AM radio station transmission.

It is appreciated that in other example embodiments of the present invention, only one of the left and right earphones 106, 102, 502, 504, 602, 604, 800, 700 respectively described earlier with reference to FIGS. 1 to 8 may be detachable from the main wire connections of the respective embodiments (e.g. 104, 508, 608). In this case, the remaining one of the left and right earphones 106, 102, 502, 504, 602, 604, 800, 700 would be permanently attached to the respective main wire connection. If both the left and right earphones are detachable from the respective main wire connections, correspondingly, the main wire connections of the respective embodiments would have a connection head suitable for detachable connection with the respective left and right earphones. If only one of the left or right earphones is detachable from the main wire connection, the main wire connection may be in the form of a retractable cable with one connection end being detachable from the left or right earphone and the other connection end permanently attached to the other earphone. Where only one of the left or right earphones is detachable, there is still existing the advantage of enabling the detachable left or right earphone to be replaced easily at times when, for instance, it is faulty, it requires battery charging or have its memory module (if present) subject to data transfer.

It is appreciated that the charger 400 described earlier with reference to FIG. 4 may have only one charging connector instead of a plurality of the same. Also, the charging connector or connectors 404 described may be a contact pad, a connector of the female type, or the like. Accordingly, the main connection port (right) (208 in FIG. 2) may instead be a matching contact pad, a connector of the male type, or the like. The charger 400 may also receive power supplied from a Direct Current Supply (e.g. batteries) instead of the Alternating Current Mains 402. The connectors 404 may be USB or Firewire connectors.

Furthermore, the charger 400 may be connected to a Desktop or portable computer and the uploading/downloading controls is controlled by the Desktop or portable computer.

It is appreciated that one or more or an array of light emitters such as LEDs may be connected to the controller 506 described earlier with reference to FIG. 5.

Furthermore, the left and right earphones 106, 102, 502, 504, 602, 604, 800, 700 respectively described earlier with reference to FIGS. 1 to 8 may comprise an ear clip or ear hook for hooking over the user's ears to hold the earphones firmly in their position at the user's ears.

Many modifications and other embodiments can be made to the system and its method by those skilled in the art having the understanding of the above described disclosure together with the drawings. Therefore, it is to be understood that the device and its utility is not to be limited to the above description contained herein only, and that possible modifications are to be included in the claims of the disclosure.

The invention claimed is:

1. An earphone set with a first earphone comprising a first sound driver for sound reproduction and a second earphone comprising a second sound driver for sound reproduction, the earphone set comprising:

a power module for powering the earphone set;

a connector for connecting the first earphone and the second earphone, wherein at least one of the first and second earphones are detachable from the connector;

a memory module for storing audio data; and a processing unit for converting the stored audio data in the memory module into sound producible by the first sound driver and the second sound driver, wherein the memory module is a non-removable component carried within at least one of the first earphone, the second earphone and the connector.

2. The earphone set as claimed in claim 1 further comprising at least one controller, wherein the at least one controller is used for stopping sound production from one or both of the first and second sound drivers.

3. The earphone set as claimed in claim 2, wherein the at least one controller is used for manipulating the tempo of the sound produced by the first and second sound drivers.

4. The earphone set as claimed in claim 3, wherein the at least one controller comprises a microphone for recording sound or for voice activation of audio playback functions.

5. The earphone set as claimed in claim 1 further comprising a plurality of controllers, wherein one controller is connected at a location along the connector closer to the first earphone and another controller is connected at a location along the connector closer to the second earphone.

6. The earphone set as claimed in claim 1, wherein the processing unit is capable of selecting stored audio data in a randomized order from the memory module for converting into sound producible at the first and second sound driver.

7. The earphone set as claimed in claim 1, wherein the processing unit is capable of selecting stored audio data in a predefined order from the memory module for converting into sound producible at the first and second sound driver.

8. The earphone set as claimed in claim 1, wherein the power supply module is chargeable and adapted to connect to a charger for charging.

9. The earphone set as claimed in claim 1, wherein the connector is a retractable cable.

10. The earphone set as claimed in claim 1, further comprising a Frequency Modulation and/or an Amplitude Modulation (FM/AM) receiver and tuner.

11. The earphone set as claimed in claim 1, wherein the memory module is configured for data transfer with an external electronic device via a wired or wireless connector.

12. The earphone set as claimed in claim 1, further comprising one or more light emitters for safety indication.

13. The earphone set as claimed in claim 1, wherein the first and second earphone each comprises an ear clip or ear hook for hooking over a respective user's ear to hold the first and second earphone firmly in their position at the user's ears.

14. An earphone comprising:

a sound driver for sound production;

a non-removable memory module for storing audio data, the memory module being carried within the earphone;

a connection port for detachable connection of the earphone via a connector to a processing unit located external to the earphone for converting the stored audio data in the memory module into sound producible by the sound driver;

a power supply module adapted to provide power to the sound driver, the memory module and the processing unit; and a power management module for preventing short circuit or inductive surge in current arising from connection or disconnection of the earphone from the connector, wherein the connector being coupled to at least one controller for manipulating sound produced by the sound driver.

15. A charger comprising one or more charging points for charging one or more of the power supply module comprised in the earphone as claimed in claim 14, the charger further comprising:

a memory device for storing audio data;

a control unit for controlling data transfer between the memory device and the memory module, and for manipulating data in the memory device and the memory; and one or more data transfer connections to connect the memory device to the memory module.

* * * * *